US005798007A

United States Patent [19]

Boyer et al.

[11] Patent Number: 5,798,007

[45] Date of Patent: Aug. 25, 1998

[54] PROCESS AND APPARATUS FOR THE CONTINUOUS HEAT TREATMENT OF A METAL STRIP TRAVELLING IN A DIFFERENT ATMOSPHERE

[75] Inventors: Michel Boyer, Chartrettes; Jean-Jacques Nozieres, Chaville, both of France

[73] Assignee: Stein Heurtey, Ris Orangis, France

[21] Appl. No.: 814,226

[22] Filed: Mar. 11, 1997

[30] Foreign Application Priority Data

Mar. 13, 1996 [FR] France ..... 96 03140

[51] Int. Cl.[6] ..... C21D 9/573; C21D 9/667

[52] U.S. Cl. ..... 148/627; 148/633; 148/634; 266/251

[58] Field of Search ..... 266/251, 252, 266/254, 255; 148/596, 634, 595, 633, 600, 627

[56] References Cited

U.S. PATENT DOCUMENTS 3,950,192 4/1976 Golland et al. .

FOREIGN PATENT DOCUMENTS 0075438 9/1982 European Pat. Off. .

2282472 3/1976 France .

7738888 12/1977 France .

3809516 10/1989 Germany .

8912111 12/1989 WIPO .

OTHER PUBLICATIONS

2326 HTM Harterei–Technische Mitteilugen 50 (1995).

*Primary Examiner*—Deborah Yee

*Attorney, Agent, or Firm*—Omri M. Behr, Esq.

[57] ABSTRACT

Process for the continuous heat treatment of a metal strip, the latter travelling through a furnace, which is thermally insulated, and in a protective atmosphere; the said furnace consisting of at least one section, for heating, for temperature hold and for cooling; the said strip being guide by a plurality of rollers arranged especially in the lower part and in the upper part of the said sections, so as to form a plurality of runs, wherein the strip passes through at least one partial or total isolating device positioned within at least one section or between two sections, so as to ensure different heat transfer properties on the strip compared with at least one other adjacent section having a different atmosphere, by adjusting the composition of the atmosphere consisting of a gas mixture whose hydrogen or helium content exceeds 5% and more particularly 15%, in order to allow differentiation of the thermomechanical properties of the atmosphere.

19 Claims, 2 Drawing Sheets

PROCESS AND APPARATUS FOR THE CONTINUOUS HEAT TREATMENT OF A METAL STRIP TRAVELLING IN A DIFFERENT ATMOSPHERE

The present invention relates to a process for the heat treatment of a metal strip. It relates more particularly to those industries consuming large amounts of sheet metal, in which the best way of making savings is to reduce the mass, and hence the thickness, of the sheet metal, while still maintaining excellent mechanical properties. The continuous annealing operation meets these expectations perfectly.

The invention applies to the technology of continuous strip treatment furnaces. Such furnaces are used in continuous annealing lines or continuous galvanizing lines; however, the invention may apply to other types of plant in which the strip is treated continuously in a protective atmosphere.

The process hinges on one or more strip annealing furnaces which consist of several sections equipped for carrying out in succession the various steps in the heat treatment cycle, which in the simplest case are: heating, temperature hold and cooling.

At the end of each of the steps, the temperature reached by the product is defined and must be stabilized so as to obtain the required metallurgical characteristics.

The operation is easy and usually carried out when the furnace operates in steady state; this is because it treats a product, of given dimensions, at a constant rate and according to a steady heat treatment curve.

Known industrial furnaces work, on a daily basis, on a strip of different thicknesses and of different widths according to heat treatment cycles which also vary.

The efficacy of the plant and the compliance with the heat treatment curves depend above all on the residence time of the strip running through the various sections of the furnace, or on the time taken to reach a temperature at the end of the heating step or of the cooling step. For each of these heating or cooling sections, a temperature gradient per unit time (° C./s) is thus expressed.

In order to improve the efficacy of their plants, users seek solutions which decrease the residence time during the heating and/or cooling steps.

Currently, the known cooling devices allowing heat exchange with the running strip essentially consist of four technologies:

- a first technology uses radiative heat exchange between the strip and air-cooled radiant tubes; the thermal gradient of the strip is very low and in all cases less than 20° C./s;
- a second technology uses conductive heat exchange between rollers and the strip, particularly heat exchange based on rollers through which water circulates; the heat exchange between the rollers and the running strip takes place by contact, something which causes heterogeneities in the temperature profile, these arising from the presence of wrinkling on the surface of the strip;
- a third technology uses convective heat exchange by spraying a water mist onto the strip or by immersing it in a water tank; the major drawback of this solution resides in the fact that it promotes oxidation of the strip, requiring the use, in order to remove this skin of oxidation, of a pickling unit on the end of the line, having a corresponding impact on the overall cost of the plant;
- a fourth technology uses convective heat exchange by blowing a recirculated protective gas, cooled beforehand in an exchanger. The thermal gradient of the strip only reaches 70° C./s with difficulty.

The present invention aims to remedy these drawbacks by providing a process which does not oxidize the running sheet metal and which guarantees good flatness and perfect surface finish, whilst still making it possible to obtain gradients which are markedly higher than those of the prior techniques having these advantages, especially of the order of 100° C./s.

For this purpose, the process for the continuous heat treatment of a metal strip, the latter travelling through a furnace, which is thermally insulated, and in a protective atmosphere; the said furnace consisting of at least one section, for heating, for temperature hold and for cooling; the said strip being guided by a plurality of rollers arranged especially in the lower part and in the upper part of the said sections, so as to form a plurality of runs, is characterized in that the strip passes through at least one partial or total isolating device positioned within at least one section or between two sections, allowing partial or total differentiation of the atmosphere present within the said section, so as to ensure, owing to the composition of the atmosphere, different heat transfer properties on the strip compared with at least one other adjacent section, having a different atmosphere.

BRIEF DESCRIPTION OF DRAWINGS

Other characteristics and advantages of the present invention will emerge from the description given hereinbelow, with reference to the appended drawings which illustrate an entirely non-limiting embodiment thereof. In the figures.

Figure 1:
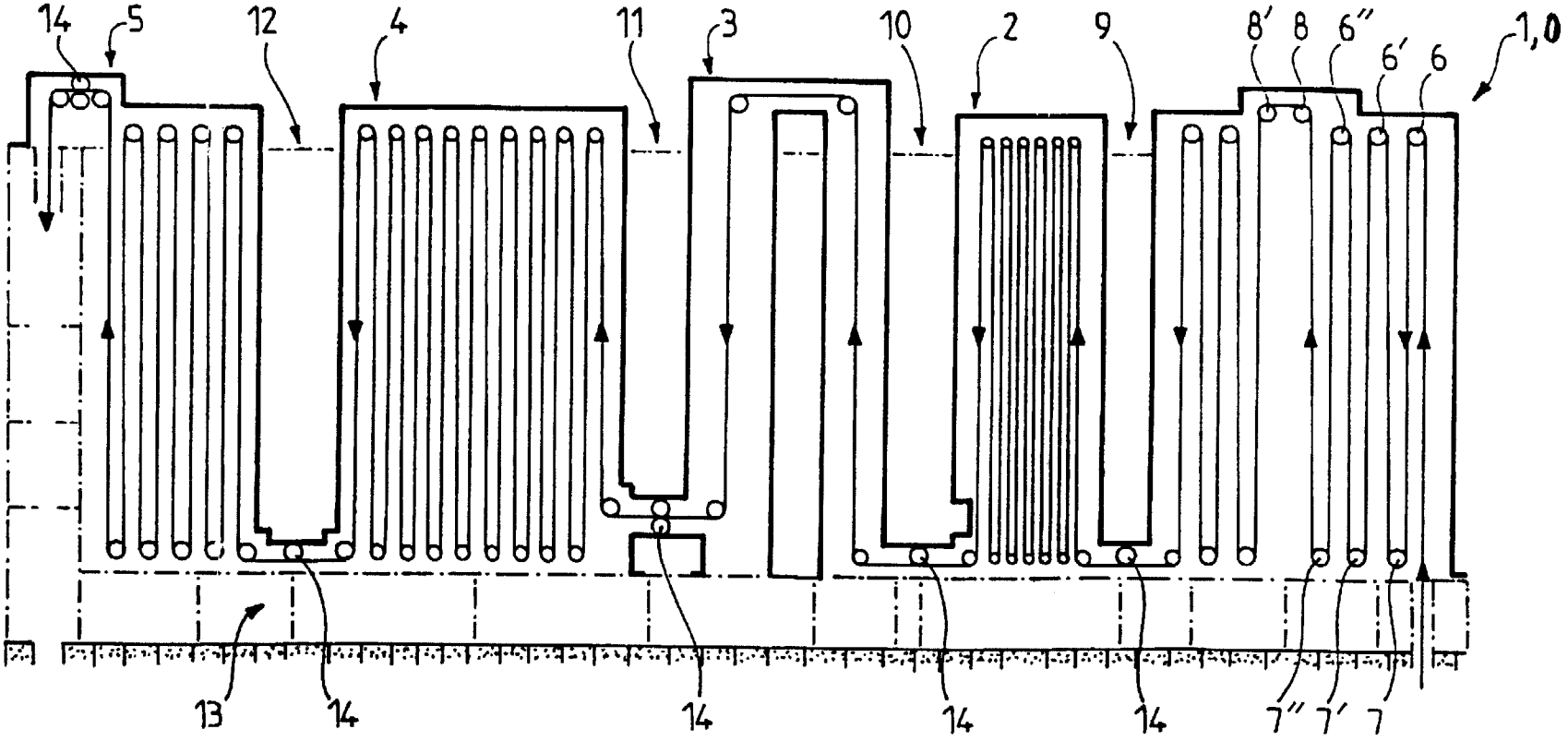
FIG. 1 is a sectional plan view of a furnace implementing the process forming the subject of the invention.
Figure 2:
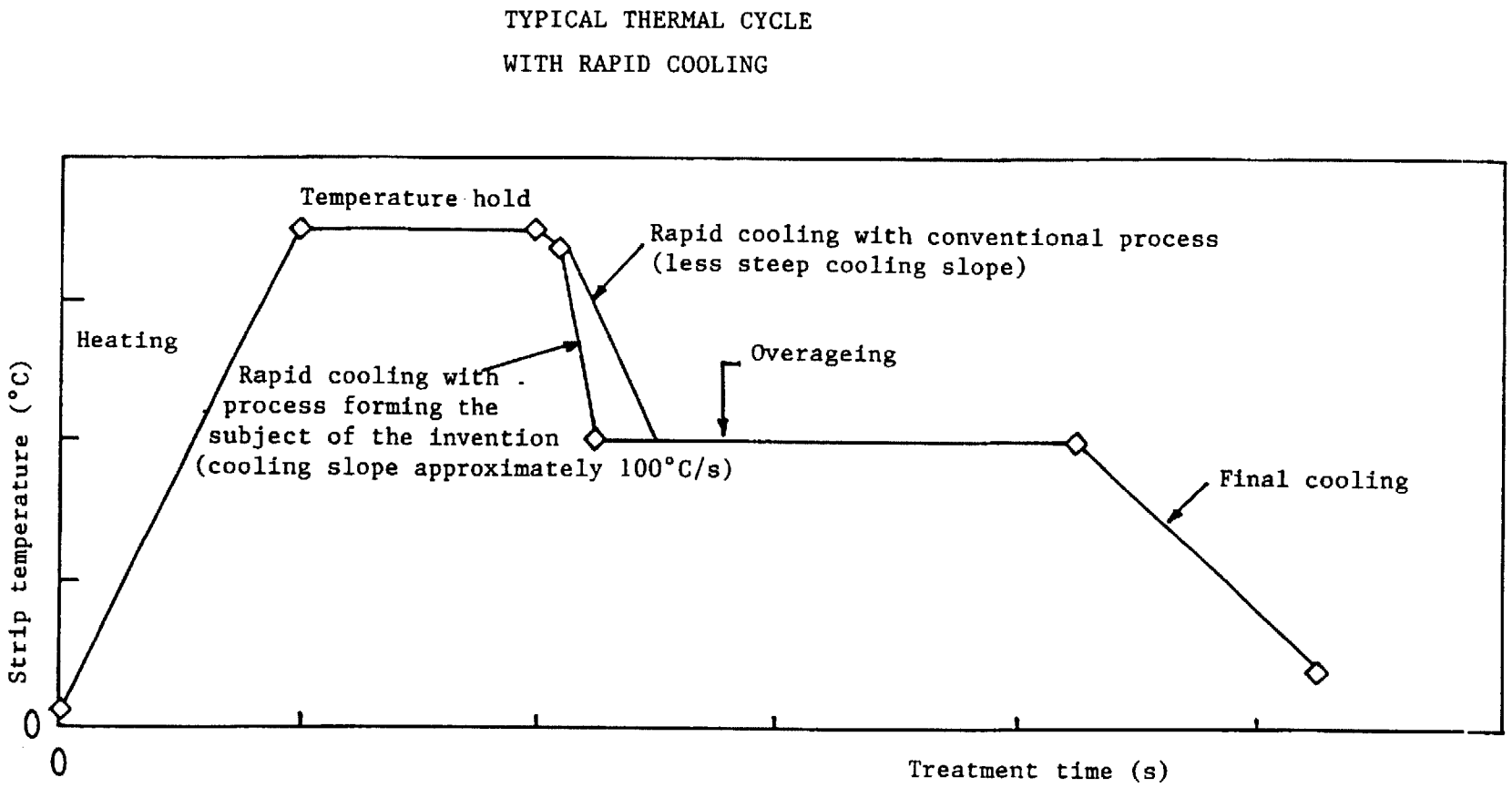
FIG. 2 is a curve illustrating a comparison between a thermal cycle undertaken according to a process of the prior art and the process forming the subject of the invention, applied to cooling.

According to a preferred method of implementing this process, the strip to be treated travels through a continuously operating vertical or horizontal furnace.

This furnace is generally composed of heating sections 1, temperature-hold sections 2 and cooling sections 3. The number and arrangement of the sections are highly varied; temperature-hold sections 2, 4 may co-exist between the various cooling sections in order to perform the crystallographic transformations correctly.

The strip therefore runs through the various sections of the furnace; in the context of a vertical furnace, it is guided by a plurality of fixed rollers 6, 6', 6", 7, 7', 7", rotationally driven, located between the upper and lower end of the volumes or chambers forming the treatment enclosures.

The strip stretches, as a loop or in runs, between two guide rollers, the top guide roller 6 and the bottom guide roller 7. Conventional heating means or induction heating means, or alternatively cooling members, are arranged between the runs of the strip or facing the outer walls.

The conventional heating means mainly consist of heating elements, of tubular shape, inside which is supported the combustion of a liquid or gaseous fuel. These elements, called radiant tubes, are placed between the runs of the strip and facing the front walls of the furnace, and heat the strip by radiation. They supply most of the energy and are used during the steady-state operation of the plant.

The combustion fume can be used to reheat a protective gas recycled through an exchanger, this gas being blown in a direction substantially perpendicular to the path of the strip through a plurality of orifices or of slots which are arranged on the blowing means. The strip is thus preheated before being heated by the radiant tubes.

It may easily be understood that all the enclosures are thermally insulated from the environments 9, 10, 11, 12, 13 by suitable lagging. Each of the enclosure is provided with devices for centering the axis of the strip along the axis of the line; these devices consist of rollers 8, 8' similar to the guiding rollers and are mounted so as to move inside supports so as to adjust the developed length between two fixed guiding points 6', 7'; if required, they may be replaced by guiding rollers and are present in the preheating section (0) or heating section 1, the temperature-hold sections 2, 4 and the cooling sections 3, 5.

The cooling means are generally formed by devices for blowing protective gas which is recycled and cooled in exchangers external to the plant. This blowing, the rate of which varies depending on the heat exchange requirements, takes place in a direction substantially perpendicular to the path of the strip and through a plurality of orifices or slots arranged on the blowing means.

The various chambers are connected together by connecting tunnels, the whole assembly optionally being maintained in a protective atmosphere, either an inert or reducing atmosphere, consisting especially of a gas mixture chosen from hydrogen and nitrogen.

According to one advantageous characteristic of the invention, a gas mixture based on hydrogen or helium is used, the composition of which exceeds the values commonly employed (of the order of 5% for 95% of nitrogen). Thus, the process according to the invention uses a hydrogen or helium atmosphere whose content may exceed 5% and more particularly 15%, in order to reach, for example, 50% of hydrogen or helium. In fact, the heating and/or cooling chambers are used in an atmosphere whose characteristics of the hydrogen or helium contents are above the explosibility limit values for these gases. The specification also applies to helium instead of or in addition to hydrogen.

The way in which the strip travels is as follows:

The strip enters a first heating enclosure 1, which comprises conventional heaters. This heating enclosure may be preceded by a preheating enclosure 0.

In these portions, the strip undergoes a temperature rise up to the desired temperature corresponding to the desired heat treatment, and then it passes into a temperature-hold chamber 2 in which the energy supply is held constant in order to carry out the crystallographic transformations. Its temperature is lowered by the previously explained means in a so-called cooling enclosure 3, the temperature decreases rapidly and the crystallographic transformations come to an end.

Next, it passes through a chamber intended for ageing, commonly called an "overageing" chamber 4, this chamber being designed in a manner similar to the temperature-hold enclosure and lying between two cooling chambers.

The final cooling 5 generally takes place either like the previous one, by gas-solid exchange, or by liquid-solid exchange, which is much more effective, by spraying liquid onto the moving strip.

The end-product is wound up or output on leaving the plant, optionally after having undergone other treatments.

According to another advantageous characteristic of the invention, the plant implementing this process includes a plurality of isolating devices 14, especially arranged within the various connecting tunnels, upstream and/or downstream, these being provided between the various heating, temperature-hold and cooling sections of which the furnace is composed, making it possible, when these isolating devices 14 are actuated, to separate adjacent sections substantially hermetically, in particular with regard to their respective atmosphere.

These isolating devices 14 consist of at least one or more sets of two rollers, these being located on each side of the strip, or of one or more sets of rollers and shutters.

It is thus possible, by virtue of these isolating devices 14, to vary, either in the sense of an increase or of a decrease about a known value, the composition of the mixture making up the protective atmosphere in one chamber with respect to an adjacent chamber separated by the said isolating device.

The process forming the subject of the invention uses as protective gas mixture nitrogen with a percentage of hydrogen or helium. The use of one of the latter gases enables the efficacy of the heating or cooling devices to be increased; it is thus possible to adjust the strip residence time within the said cooling section 3 or preheating section 0 for the purpose of increasing the value of the gradient (° C./s) above that known in the current techniques.

Thus, according to a first method of using the process forming the subject of the invention, it is possible to isolate and to use a convective cooling section 3 (the recirculated atmosphere gas, after it has been cooled, especially by a gas/water exchanger, is blown onto the strip), and to fill this section with gas having a high level of hydrogen or helium since these gases have thermomechanical properties (specific heat, viscosity, density, conductivity, etc.) which are more favourable than nitrogen, thereby making it possible to increase the exchange coefficient or to decrease the size of the fans, or both.

A temperature gradient having values ranging from 75° C./s to 150° C./s and preferably having values close to 100° C./s is thus achieved, instead of 70° C./s with the current technique.

Thus, according to a second method of using the process forming the subject of the invention, it is possible to isolate and use a convective preheating section 0 (the recirculated atmosphere gas, after it has been reheated, especially by a gas/fume exchanger, is blown onto the strip), and to fill this section with a gas having a high level of hydrogen or helium since these gases have thermomechanical properties (specific heat, viscosity, density, conductivity, etc.) which are more favourable than nitrogen, thereby making it possible to increase the exchange coefficient or to decrease the size of the fans, or both.

Whatever the method of using the process, strip residence times within the furnace are thus achieved which are markedly shorter than the values in the prior art.

It remains the case, of course, that the present invention is not limited to the embodiments described and represented hereinabove, but that it encompasses all variants thereof.

We claim:

1. Plant for the continuous heat treatment of a metal strip traveling through a thermally isolated furnace said furnace comprising:

at least one heating section, at least one cooling section having means for blowing a gas onto the metal strip, said sections being provided, in their upper and lower parts, with a plurality of guide rollers for guiding the strip, guide rollers for guiding the strip, connecting tunnels for connecting said sections together, a plurality of isolating devices provided to the said tunnels, said isolating devices enabling at least one cooling section and at least one heating section to be sealed from at least one neighboring section, at least one isolating device is located at at least one of a point prior to the entry of the strip into and a point subsequent to exit from said at least one cooling section, at least one isolating device is located at at least one of a point prior to the entry of the strip into and a point subsequent to exit from said at least one heating section, and a protective atmosphere in said sealed section, said atmosphere having properties enabling the cooling capacity of the said section to be increased relative to at least one neighboring section, by virtue of an increase in the gradient across said section (° C./s).

2. Plant according to claim 1, additionally comprising at least one temperature-hold section.

3. Plant according to claim 1, additionally comprising an ageing section.

4. Plant according to claim 1, additionally comprising a further, final, cooling section.

5. Plant according to claim 1 wherein the isolating devices consist of at least one set of rollers, located on each side of the strip.

6. Plant according to claim 1 wherein the isolating devices consist of at least one set of rollers and shutters, located on each side of the strip.

7. Plant for the continuous heat treatment of a metal strip traveling through a thermally isolated furnace said furnace comprising:

at least one preheating section, at least one heating section, at least one cooling section having means for blowing a gas onto the metal strip, said sections being provided, in their upper and lower parts, with a plurality of guide rollers for guiding the strip, connecting tunnels for connecting said sections together, a plurality of isolating devices provided to the said tunnels, said isolating devices enabling at least one cooling section to be sealed from at least one neighboring section, at least one isolating device is located at at least one of a point prior to the entry of the strip into and a point subsequent to exit from said at least one cooling section, at least one isolating device is located at at least one of a point prior to the entry of the strip into and a point subsequent to exit from said at least one heating section, and a protective atmosphere in said sealed section, said atmosphere having properties enabling the heating capacity of the said section to be increased relative to at least one neighboring section, by virtue of an increase in the gradient across said section (° C./s).

8. Plant according to claim 7 wherein at least one isolating device is located at at least one of a point prior to the entry of the strip into and a point subsequent to exit from said at least one preheating section.

9. Plant according to claim 7, additionally comprising at least one temperature-hold section.

10. Plant according to claim 7, additionally comprising an ageing section.

11. Plant according to claim 7, additionally comprising a further, final, cooling section.

12. Plant according to claim 7 wherein the isolating devices consist of at least one set of rollers, located on each side of the strip.

13. Plant according to claim 7 wherein the isolating devices consist of at least one set of rollers and shutters, located on each side of the strip.

14. Process for the continuous heat treatment of a metal strip to achieve different heat transfer properties in adjacent sectors thereof which comprises passing said strip through a plant of claim 1 wherein the atmosphere in the cooling segment comprises at least 5% of hydrogen or helium, and adjusting the proportion of hydrogen or helium in the atmosphere of said at least one cooling section to be different from that in at least one neighboring section.

15. Process for the continuous heat treatment of a metal strip to achieve different heat transfer properties in adjacent sectors thereof which comprises passing said strip through a plant of claim 1 wherein the atmosphere in the cooling segment comprises 5–50% of hydrogen, and adjusting the proportion of hydrogen in the atmosphere of said at least one cooling section to be different from that in at least one neighboring section.

16. Process for the continuous heat treatment of a metal strip to achieve different heat transfer properties in adjacent sectors thereof which comprises passing said strip through a plant of claim 1 wherein the atmosphere in the cooling segment comprises 5–50% of helium, and adjusting the proportion of helium in the atmosphere of said at least one cooling section to be different from that in at least one neighboring section.

17. Process for the continuous heat treatment of a metal strip to achieve different heat transfer properties in adjacent sectors thereof which comprises passing said strip through a plant of claim 7 wherein the atmosphere in the cooling segment comprises at least 5% of hydrogen or helium, and adjusting the proportion of hydrogen or helium in the atmosphere of said at least one cooling section to be different from that in at least one neighboring section.

18. Process for the continuous heat treatment of a metal strip to achieve different heat transfer properties in adjacent sectors thereof which comprises passing said strip through a plant of claim 7 wherein the atmosphere in the cooling segment comprises 5–50% of hydrogen, and adjusting the proportion of hydrogen or helium in the atmosphere of said at least one cooling section to be different from that in at least one neighboring section.

19. Process for the continuous heat treatment of a metal strip to achieve different heat transfer properties in adjacent sectors thereof which comprises passing said strip through a plant of claim 7 wherein the atmosphere in the cooling segment comprises 5–50% of helium, and adjusting the proportion of helium in the atmosphere of said at least one cooling section to be different from that in at least one neighboring section.

* * * * *